US011248517B2

(12) United States Patent
Jüstel

(10) Patent No.: US 11,248,517 B2
(45) Date of Patent: Feb. 15, 2022

(54) INTERNAL COMBUSTION ENGINE

(71) Applicant: VOLKSWAGEN AKTIENGESELLSCHAFT, Wolfsburg (DE)

(72) Inventor: Steffen Jüstel, Altmärkische Höhe (DE)

(73) Assignee: VOLKSWAGEN AKTIENGESELLSCHAFT, Wolfsburg (DE)

( * ) Notice: Subject to any disclaimer, the term of this patent is extended or adjusted under 35 U.S.C. 154(b) by 0 days.

(21) Appl. No.: 16/340,343

(22) PCT Filed: Sep. 28, 2017

(86) PCT No.: PCT/EP2017/074626
§ 371 (c)(1),
(2) Date: Apr. 8, 2019

(87) PCT Pub. No.: WO2018/069053
PCT Pub. Date: Apr. 19, 2018

(65) Prior Publication Data

US 2019/0234290 A1 Aug. 1, 2019

(30) Foreign Application Priority Data

Oct. 10, 2016 (DE) ..... 10 2016 119 181.7

(51) Int. Cl.
*F01P 7/16* (2006.01)
*F01P 11/02* (2006.01)
(Continued)

(52) U.S. Cl.
CPC ..... *F01P 7/161* (2013.01); *F01P 3/02* (2013.01); *F01P 3/20* (2013.01); *F01P 7/165* (2013.01);
(Continued)

(58) Field of Classification Search
CPC ..... F01P 7/161; F01P 11/0204; F01P 11/029; F01P 3/02; F01P 3/20; F01P 7/167; F01P 2007/146
(Continued)

(56) References Cited

U.S. PATENT DOCUMENTS

2003/0098077 A1 5/2003 McLane et al.
2004/0173167 A1 9/2004 Chanfreau et al.
(Continued)

FOREIGN PATENT DOCUMENTS

CN 201614962 U 10/2010
CN 105745411 A 7/2016
(Continued)

OTHER PUBLICATIONS

International Search Report of PCT Application No. PCT/EP2017/074626, dated Nov. 8, 2017.
(Continued)

*Primary Examiner* — Lindsay M Low
*Assistant Examiner* — Omar Morales
(74) *Attorney, Agent, or Firm* — Pearl Cohen Zedek Latzer Baratz LLP

(57) ABSTRACT

The invention relates to an internal combustion engine comprising a combustion engine (10) and a cooling system, which has a coolant pump (40), a main cooler (38), a heating heat exchanger (36), coolant channels (28, 30) in the combustion engine (10), and a control device (20) having an
(Continued)

actuator (26) for the closed-loop distribution of a coolant according to at least one local coolant temperature, characterised in that the control device (20) can be connected to a coolant compensation container (106) via a connection in line and, with an actuation of the actuator (26) in one direction, the control device (20): permits a coolant flow through the coolant channels (28, 30) of the combustion engine (10), and through the heating heat exchanger (36), and prevents same through the main cooler (38), and closes the connection line in a first primary position (80); releases the connection line in a second primary position (96); and also permits a coolant flow though the main cooler (38) in a third primary position (126).

10 Claims, 4 Drawing Sheets

(51) Int. Cl.
*F01P 3/20* (2006.01)
*F01P 3/02* (2006.01)
*F01P 7/14* (2006.01)

(52) U.S. Cl.
CPC ..... *F01P 7/167* (2013.01); *F01P 11/0204* (2013.01); *F01P 11/029* (2013.01); *F01P 2007/146* (2013.01); *F01P 2060/08* (2013.01)

(58) Field of Classification Search
USPC ..... 123/41.44
See application file for complete search history.

(56) References Cited

U.S. PATENT DOCUMENTS

| | | | | |
|---|---|---|---|---|
| 2016/0325601 | A1* | 11/2016 | Richter | F01P 7/167 |
| 2017/0030252 | A1* | 2/2017 | Richter | F01P 11/0285 |
| 2017/0298805 | A1* | 10/2017 | Kloft | F01P 7/167 |

FOREIGN PATENT DOCUMENTS

| | | | |
|---|---|---|---|
| CN | 105745412 | A | 7/2016 |
| DE | 103 42 935 | A1 | 4/2005 |
| DE | 10 2010 044 167 | A1 | 5/2012 |
| DE | 10 2014 201 170 | A1 | 7/2015 |
| DE | 10 2014 219 252 | A1 | 4/2016 |
| FR | 2 800 125 | A1 | 4/2001 |
| JP | 4741794 | B | 8/2011 |
| RU | 127823 | U1 | 5/2013 |
| SU | 1456621 | A1 | 2/1989 |
| SU | 1571282 | A1 | 6/1990 |
| WO | WO 2008/053089 | A1 | 5/2008 |
| WO | WO 2016/045895 | A1 | 3/2016 |

OTHER PUBLICATIONS

Search report for Russian Patent Application No. 2019110425/12, dated Nov. 24, 2020.
Examination report for Chinese Patent Application No. 201780062712.8, dated Aug. 3, 2020.
Office Action for Korean Patent Application No. 10-2019-7013045, dated Jul. 28, 2021.

* cited by examiner

INTERNAL COMBUSTION ENGINE

CROSS-REFERENCE TO RELATED APPLICATIONS

This application is a National Phase Application of PCT International Application No. PCT/EP2017/074626, International Filing Date Sep. 28, 2017, claiming priority of German Patent Application No. 10 2016 119 181.7, filed Oct. 10, 2016, which is hereby incorporated by reference.

FIELD OF THE INVENTION

The invention relates to a combustion machine having a cooling system. The invention also relates to a method for filling the cooling system of such a combustion machine with coolant.

BACKGROUND OF THE INVENTION

As a rule, combustion machines for motor vehicles have a cooling system in which a coolant is pumped in at least one cooling circuit by means of one or more pumps, a process in which thermal energy is absorbed from components that are integrated into the cooling circuit, especially from an internal combustion engine as well as from an oil cooler and/or from an intercooler. In an ambient heat exchanger, the so-called primary cooler or primary water cooler, as well as at times in a heating heat exchanger, this thermal energy is subsequently released into the ambient air; in the case of the heating heat exchanger, this thermal energy is released into the ambient air provided for the climate control of the interior of the motor vehicle.

Cooling systems of modern motor vehicles often have several cooling circuits. For instance, it is a known procedure to provide a so-called large cooling circuit or primary cooling circuit as well as a small cooling circuit, sections of which have an integral configuration, and whereby a thermostat-controlled valve is used to convey the coolant either via the large cooling circuit or via the small cooling circuit. This is done as a function of the temperature of the coolant, so that, for example, during a warm-up phase of the combustion machine, when the coolant has not yet reached a prescribed operating temperature range, the coolant is conveyed in the small cooling circuit, thus bypassing the primary cooler, that is to say, the ambient heat exchanger in which the coolant is cooled mainly by heat transfer to the ambient air. In contrast, once the coolant has reached the prescribed operating temperature range, the coolant is conveyed in the large cooling circuit by means of the thermostat-controlled valve, so that overheating of the cooling system is prevented due to the transfer of heat from the coolant to the ambient air. The heating heat exchanger, as the second ambient heat exchanger, in contrast, is normally integrated into the small cooling circuit, as a result of which the interior of the motor vehicle can already be heated during the warm-up phase of the combustion machine.

The (main) coolant pump of the cooling system is regularly driven mechanically by the internal combustion engine of the combustion machine. Its pumping capacity is thus fundamentally proportional to the rotational speed at which the crankshaft of the internal combustion engine is rotating. Although the demand for cooling capacity also tends to increase as the rotational speed of the internal combustion engine rises, in many operating states, the cooling capacity that can theoretically be achieved by the operation of the pump does not correspond to the actual demand for cooling capacity. Since a sufficiently high cooling capacity should be available in all operating states, such mechanically driven pumps are often over-dimensioned. Consequently, efforts aimed at reducing the fuel consumption of motor vehicles have led to the development of mechanically driven coolant pumps that can be regulated within certain limits in terms of their volumetric flow rate. Such a regulatable mechanically driven coolant pump is disclosed, for example, in German patent application DE 10 2010 044 167 A1.

When it comes to the cooling systems of modern motor vehicles, the main regulation of the volumetric flow of coolant can be achieved by means of regulatable coolant pumps, whereas the distribution of the volumetric flow among the individual components that each have a different cooling requirement can be achieved by valves that are actively controlled, especially by means of thermostats. German patent application DE 103 42 935 A1, for instance, discloses a combustion machine with a cooling circuit comprising a pump that is mechanically driven by an internal combustion engine. The volumetric flow rate of the pump is thus dependent on the rotational speed of the internal combustion engine. In order to attain individually adapted volumetric flow rates of the coolant for several heat exchangers that are integrated into the cooling circuit, especially such as cooling channels of a cylinder block and of a cylinder head of the internal combustion engine, as well as for a heating heat exchanger that serves to heat the interior of a motor vehicle driven by a combustion machine, a plurality of control valves that can each be actuated individually are integrated into the cooling circuit. German patent application DE 103 42 935 A1 also discloses that the channels of the cylinder block and of the cylinder head are connected in parallel, which makes it possible to individually regulate the cooling capacity for these components. The cooling system known from German patent application DE 103 42 935 A1 is relatively complex.

A combustion machine according to the generic part of claim 1 is described in German patent application DE 10 2014 219 252 A1. This combustion machine comprises a regulator that makes it relatively easy to achieve an operation-dependent adapted coolant feed to the various components of a cooling system of the combustion machine, which is done by means of an actuator that moves a first lock valve and by means of a second lock valve that, in certain phases, is moved along by the first lock valve.

In order for a cooling system of a motor vehicle to have a good and very efficient cooling capacity, it is relevant for this system to be vented as thoroughly as possible. Accordingly, for one thing, the air that is present in the cooling circuit and that is displaced by the inflowing coolant has to be removed as thoroughly as possible during the filling procedure of the cooling circuit, especially at the time of the initial filling or a re-filling within the scope of maintenance work. Moreover, during the operation of the motor vehicle and thus of the cooling system, gas that can form due to evaporation processes has to be safely removed. This is particularly the case when the cooling circuit is configured for an operating temperature of the coolant that is above the (pressure-dependent) boiling temperature of water. Water that has accumulated or been deposited in the cooling circuit then evaporates and has to be appropriately removed.

Venting the cooling system of a motor vehicle is done via a so-called expansion tank. Such an expansion tank also has the task of compensating for thermally induced volume changes of the coolant and to this end, it is partially filled with air. For venting purposes, at least one vent line can lead from a place in the cooling system that is usually high to the expansion tank, which is arranged even higher. In order to compensate for the thermally induced volume change of the coolant, there is also at least one overflow line through which coolant can be exchanged between the expansion tank and the cooling circuit that is connected to said expansion tank via the overflow line.

Before the backdrop of this state of the art, the invention was based on the objective of adapting the cooling capacity of the cooling system in a manner that even better meets the requirements in a combustion machine according to German patent application DE 10 2014 219 252 A1. Moreover, a possibility is to be put forward for advantageously filling a cooling system with coolant in the case of a combustion machine according to German patent application DE 10 2014 219 252 A1.

SUMMARY OF THE INVENTION

These objectives are achieved by means of a combustion machine according to the claims. A method for filling the cooling system of the combustion machine with coolant, which is rendered possible by the configuration according to the invention of a combustion machine, is the subject matter of other claims. Advantageous embodiments of the combustion machine according to the invention and preferred embodiments of the method according to the invention are the subject matters of the additional claims and/or they ensue from the description of the invention given below.

The invention is based on the realization that a considerable amount of coolant is exchanged between a then small cooling circuit—in which the cooling system is being operated—and the expansion tank, even already during a warm-up phase of the combustion machine in which the primary goal is to reach defined operating temperature ranges as quickly as possible for at least some of the components that are integrated into the cooling system. This leads to undesired losses of thermal energy in the expansion tank, which can especially delay the warm-up of an internal combustion engine of the combustion machine until the operating temperature range is reached. This delayed warm-up can be associated with greater fuel consumption as well as with greater exhaust gas emissions.

Therefore, an underlying notion of the invention is to delay an exchange of coolant between the then actively used cooling circuit and the expansion tank to the greatest extent possible in order to minimize the described losses of thermal energy during a warm-up phase. Accordingly, it is to be provided that the functionality of the expansion tank can be activated in the cooling system on an as-needed basis. At the same time, in order not to substantially increase the structural complexity of the cooling system in spite of this functionality, it is provided according to the invention for this functionality to be advantageously achieved by an additional setting for the regulator of the combustion machine disclosed in German patent application DE 10 2014 219 252 A1.

Towards this end, according to the invention, a combustion machine is provided that has at least one internal combustion engine and a cooling system, whereby the cooling system has at least one coolant pump, a primary cooler, a heating heat exchanger, coolant channels in the internal combustion engine as well as a regulator with a (preferably electric, optionally hydraulic and/or pneumatic) actuator which serves for a regulated distribution of the coolant as a function of at least one local coolant temperature. When it comes to such a combustion machine, it is additionally provided according to the invention that the regulator can be connected to the coolant expansion tank via a connecting line and, when the actuator is actuated in one (actuating or movement) direction, the regulator,

- when it is in a first main position, allows coolant to flow through the coolant channels of the internal combustion engine as well as through the heating heat exchanger and prevents coolant from flowing through the primary cooler, and also closes off the connecting line;
- when it is in a second main position, additionally opens the connecting line; and
- when it is in a third main position, additionally allows coolant to flow through the primary cooler.

This configuration of the combustion machine allows an advantageous regulation and distribution of the coolant in the cooling system already by means of just one actuator.

In particular, it can be provided in this context that, when the regulator is in the first position, only a relatively small volumetric flow of the coolant is pumped by the coolant pump through a small cooling circuit (which bypasses the primary cooler) of the cooling system, whereby coolant flows only through the internal combustion engine (at least partially) and through the heating heat exchanger. Since only a relatively small volumetric flow of the coolant is pumped through the internal combustion engine, then, after a cold start of the combustion machine, a quick warm-up of the appropriate portion of coolant can be achieved and consequently, the heating heat exchanger begins to function relatively soon, and so does the heating system of the motor vehicle for whose drive the combustion machine has preferably been provided.

The term "heating heat exchanger" is to be understood as referring to a heat exchanger in which heat is transferred from the coolant of the cooling system to the ambient air that is provided for heating the interior of a motor vehicle.

In comparison to the combustion machine according to German patent application DE 10 2014 219 252 A1, in a combustion machine according to the invention, a (fluidic) integration of a coolant expansion tank into the cooling system is achieved by means of the regulator on an as-needed basis. Since the regulator only opens the connecting line when the former is in the second main position, this can make it possible—after a cold start of the combustion machine—to only carry out venting or compensation of a volume change of the coolant by means of the expansion tank once this has become necessary because the coolant in the internal combustion engine has already warmed up considerably. This can prevent a loss of thermal energy in the expansion tank from negatively affecting the fastest possible warm-up of the internal combustion engine after a cold start of the combustion machine.

When the regulator is in the third main position, the primary cooler is then activated which, through a transfer of heat from the coolant to the ambient air specifically with the exclusive purpose of cooling the coolant, prevents overheating of the cooling system or of the components integrated therein. In this manner, it can be provided that, when the regulator is in the third position, the coolant is conveyed in a large cooling circuit of the cooling system.

The connecting line that connects the expansion tank to the regulator can preferably be a vent line that connects the regulator to a section of the expansion tank that is provided to hold air during operation of the combustion machine. In this manner, an effective venting of the regulator can be achieved at the same time. However, it is also fundamentally possible for the connecting line to be an overflow line that connects the regulator to a section of the expansion tank that is provided to hold coolant during operation of the combustion machine.

A combustion machine according to the invention, however, permits not only an advantageous as-needed venting of the cooling system during operation of the combustion machine, but also an advantageous filling of the cooling system with coolant, especially when the combustion machine is not in operation, for example, within the scope of assembly or maintenance work. For this purpose, with a method according to the invention, it can be provided that the regulator is switched to the third main position in order to fill the cooling system, ensuring not only that the coolant is distributed essentially completely within the cooling system but also that the air displaced from the cooling system by the introduced coolant is vented via the connecting line that remains open in the third main position.

A combustion machine according to the invention can preferably also comprise a bypass that bypasses the heating heat exchanger, whereby it can then also be provided that, when the actuator is actuated, the regulator, when it is in a first main position and preferably also in the second main position, prevents coolant from flowing through the bypass as well as through the primary cooler, and when it is in a first intermediate position that follows the second main position, additionally allows coolant to flow through the bypass.

As the operating temperature of the combustion machine rises, the cooling system can be prevented from overheating by activating the bypass when the regulator is in the first intermediate position so that a larger volumetric flow of coolant continues to be pumped through the internal combustion engine in the small cooling circuit, thus bypassing the primary cooler. The bypass that bypasses the heating heat exchanger can be advantageous here since the maximum volumetric flow through the heating heat exchanger—which is limited by the cross sections of the flow layouts of the heating heat exchanger and of the lines of the cooling system that lead to and away from the heating heat exchanger—is preferably dimensioned so as to be relatively small, as a result of which it is not the entire volumetric flow of coolant that can and should be conveyed through the heating heat exchanger when the regulator is in the second position. This is particularly the case because it can be provided that coolant flows through the heating heat exchanger when the regulator is in the first main position as well as in all subsequent positions.

In a preferred embodiment of the combustion machine according to the invention, in order to ensure that, in the third main position, the entire amount of coolant is conveyed through the heating heat exchanger and through the primary cooler, it can be provided that, when the regulator is in the third main position, it once again prevents coolant from flowing through the bypass.

In another preferred embodiment of the combustion machine according to the invention, the regulator can be provided with a zero position that is before the first main position. In this context, it is provided that, when the regulator is in this zero position, it completely prevents coolant from flowing through the cooling system. This can be achieved especially preferably in that, when the regulator is in the zero position, it interrupts the cooling system in a section located between the coolant pump and the internal combustion engine, especially on the pressure side of the coolant pump.

An advantageous cooling of the internal combustion engine of the combustion machine according to the invention can be achieved when a cylinder housing (especially a cylinder block) as well as a cylinder head of the internal combustion engine each have at least one cooling channel, whereby the coolant flows through the cooling channels so as to be controlled by the regulator on an as-needed basis. In this context, it can especially be provided that, when the regulator is in the first main position, it allows coolant to flow through the coolant channel of the cylinder head and it prevents coolant from flowing through the coolant channel of the cylinder housing. In this manner, it can be achieved that, during operation of the combustion machine following a cold start, the coolant flows only through the cylinder head (and through the heating heat exchanger) of the combustion machine, whereby said cylinder head is thermally stressed to a greater extent than the cylinder housing and it has a lower mass that, in this operating state of the combustion machine, might still absorb thermal energy from the coolant, as a result of which it is possible to achieve not only the quick warming up of the coolant, which is advantageous for the heating capacity of the heating heat exchanger, but at the same time, to also already achieve cooling of the cylinder head. In contrast, no provision is made yet for coolant to flow through the coolant channel of the cylinder housing, as a result of which it can be achieved that, in this operating state, the cylinder walls of the cylinder housing can warm up faster, which has a positive impact on friction losses between the cylinder and the piston as well as on the emission behavior of the combustion machine.

The coolant channel of the cylinder housing is preferably only connected to the cooling system once the regulator is in a (second) intermediate position between the second main position and the third main position, especially preferably in a (second) intermediate position between the first intermediate position and the third main position, whereby then the operating temperature of the combustion machine can already be so high that it is appropriate or necessary to cool the cylinder housing as well.

In another preferred embodiment of the combustion machine according to the invention, it can be additionally provided that it is possible to switch between at least two of the positions of the regulator, either in steps or else continuously, so that the regulator can be set and also be kept in one or more partial steps. This permits an improved adaptation of the flow of coolant through the individual components as a function of the actual demand. Such a configuration of the combustion machine can be particularly useful if the coolant pump cannot be regulated independently of its pumping speed in terms of the volumetric flow rate. This can especially be the case with a coolant pump that is driven directly by the internal combustion engine.

It can also be provided that the regulator can be switched between at least two of its positions, and especially between the second intermediate position and the third position, as a function of an engine characteristic map of the combustion machine. Such an engine characteristic map can especially show the load plotted over the rotational speed at which the combustion machine is operated. This advantageously allows the transfer of heat from the coolant to the ambient air in the primary cooler to be controlled as a function of the operating state and consequently as a function of the heat generation of the combustion machine. This makes it possible, for instance, to keep the temperature of the coolant largely constant or, whenever necessary, to regulate it to a defined value (range) that can also be especially dependent on the operating state of the combustion machine. Particularly in the case of a relatively low load and/or rotational speed, a higher coolant temperature can be set which can lead to a correspondingly high oil temperature and thus to relatively low friction losses. Conversely, in the case of a higher load and/or rotational speed, the coolant temperature can be reduced in order to protect the internal combustion engine from a thermal overload. This makes it possible to also perform a predictive control of the temperature of the coolant, a procedure which, unlike, for example, regulation by means of a temperature sensor, is not configured to (only) respond to a temperature change that has already taken place. In this context, it can be especially preferably provided that switching between the at least two positions is carried out in steps or continuously as a function of the engine characteristic map of the combustion machine.

In an embodiment of the combustion machine according to the invention that can advantageously be implemented structurally, it can be provided that the regulator comprises a lock valve that is moved by the actuator in a translatory and/or rotatory manner, whereby the movement of the lock valve effectuated by means of the actuator leads to a closing or opening of inlets and/or outlets corresponding to the positions of the regulator, said inlets and/or outlets fluidically connecting the regulator to appertaining components of the cooling system.

In order to achieve a closing of the connecting line in the first main position and an opening in the second main position (and preferably in every position except for the first main position) of the regulator, the lock valve can preferably have a section in which, within a movement range that can be actuated by the actuator, the lock valve is congruent with an outlet of the connecting line, whereby a portion of this section is formed by a through opening that is fluidically connected to a volume of the regulator that is provided to convey coolant.

In this context, it can be especially preferably provided for the outlet to be formed by a tubular connecting piece whose one end is mounted, either directly or via an interconnected sealing element that can especially be made of an elastic material, in such a way that it slides on the lock valve when the lock valve is moved by the actuator.

In a structurally advantageous manner, the sealing element can be configured as a pipe plug that is inserted into the end of the connecting piece.

It might also be advantageous for the regulator to be provided with more than one lock valve, whereby then, it is preferably provided that only the first of the lock valves is moved by the actuator, whereas a movement of the other lock valve or valves (in at least one segment of the movement of the first lock valve) is effectuated by the first lock valve.

In a structurally and functionally advantageous embodiment, it can be provided for the regulator to have a first lock valve that is moved by the actuator and a second lock valve that is moved by the first lock valve, whereby the second lock valve is provided (preferably exclusively) for purposes of reaching a preferably provided zero position of the regulator in that the second lock valve, when it is in a closed position, totally prevents coolant from flowing through the cooling system. In this context, it can be especially preferably provided that, in its range of movement, the first lock valve only moves the second lock valve along partially. This especially allows a simplified embodiment of the second lock valve which, in the preferred embodiment of the combustion machine according to the invention, is only moved when the regulator is switched between the zero position and the first main position, whereas a movement of the second lock valve when the regulator is switched between the other positions by means of the first lock valve is no longer provided for. Such a coupling of the first and second lock valves can be attained, for instance, by means of a coupler lever mechanism, a Geneva gearing and/or a cam mechanism.

The position of the second lock valve, which might not be permanently coupled to the first lock valve, can especially be secured by means of a non-positive connection in that forces that overcome the non-positive connection are required in order to move the second lock valve, and these forces are greater than those that result from the mass of the second lock valve, that is to say, caused by inertia or gravity, and/or due to hydraulic pressure of the coolant onto the second lock valve in the directions of movement made possible by the positioning of the second lock valve. Alternatively or additionally, it is also possible to secure the position by means of a positive connection. Here, in particular, the position of the second lock valve can be secured by the first lock valve.

An embodiment of the combustion machine according to the invention that is structurally simple and advantageous, especially in terms of the required installation space, is characterized in that the lock valve(s) is/are configured as rotary valves.

The actuator of the regulator is also preferably actuated as a function of a local temperature associated with the internal combustion engine, said temperature being especially preferably measured in a coolant channel (particularly preferably at a place that is closer to an outlet than to an inlet of this coolant channel) and/or in a section of the cooling system that is connected to an outlet of this coolant channel. For this purpose, the combustion machine according to the invention can have a coolant temperature sensor arranged in the coolant channel of the internal combustion engine or in a coolant line connected directly to this coolant channel, as seen in the flow direction of the coolant.

If only one temperature sensor is to be provided here, it is then preferably located in a coolant channel of the cylinder head. An improved regulation of the distribution of the coolant by means of the regulator, however, can be achieved in that the regulator is actuated as a function of a local temperature of the coolant in the cylinder head and as a function of a local temperature of the coolant in the cylinder housing. Accordingly, a first coolant temperature sensor that is situated in a coolant channel of the cylinder head as well as a second coolant temperature sensor that is situated in a coolant channel of the cylinder housing can be provided.

The indefinite articles ("a", "an"), especially in the patent claims and in the description that generally explains the patent claims, are to be understood as such and not as numbers. Therefore, components described in a concrete manner should be understood in such a way that they are present at least once and can also be present several times.

BRIEF DESCRIPTION OF THE DRAWINGS

The combustion machine according to the invention will be explained in greater detail below making reference to the embodiments shown in the drawings. The drawings show the following.

DETAILED DESCRIPTION OF THE INVENTION

Figure 1:
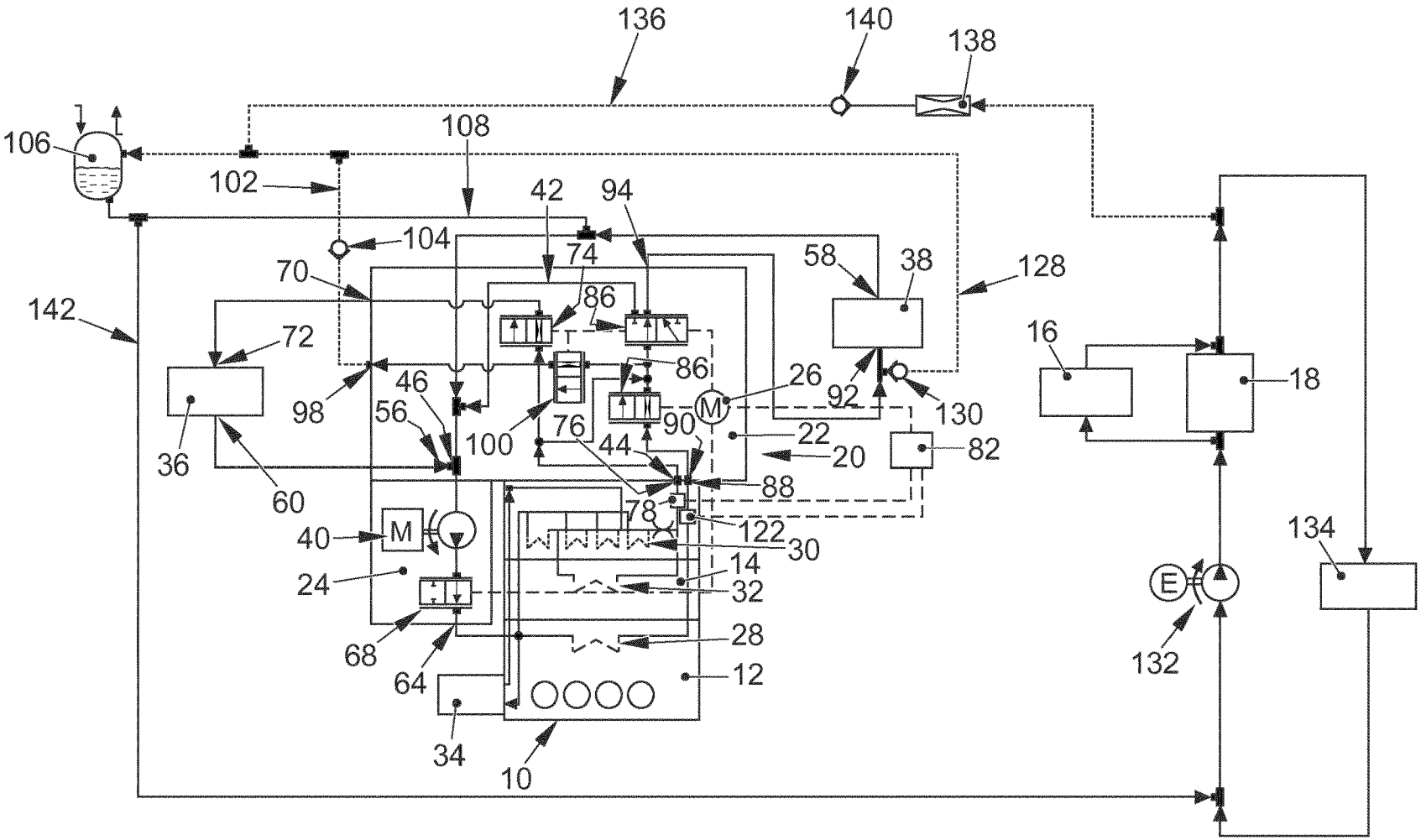
FIG. 1: a combustion machine according to the invention, schematically in a block diagram.

FIG. 1 schematically shows a combustion machine according to the invention. It comprises an internal combustion engine 10 that can be configured, for instance, as a reciprocating-piston internal combustion engine based on the Otto or Diesel principle and that comprises a cylinder housing 12 as well as a cylinder head 14. Moreover, the combustion machine also has a primary cooling system and a secondary cooling system. The primary cooling system serves primarily to cool the internal combustion engine 10, whereas the secondary cooling system serves to cool an exhaust gas turbocharger 16 and an intercooler 18 of the charged internal combustion engine 10. Here, the temperature of the coolant during regular operation of the combustion machine can be considerably higher in the primary cooling system than in the secondary cooling system, at least in certain sections, so that the former can also be referred to as a high-temperature cooling system and the latter as a low-temperature cooling system.

The primary cooling system also comprises a regulator 20 with a first lock valve 22, a second lock valve 24 and an actuator 26. The first lock valve 22 can be moved by means of the actuator 26, whereas, in a section of the total possible movement of the first lock valve 22, the second lock valve 24 would be moved along by the first lock valve 22. The primary cooling system also comprises coolant channels 28, 30 of the cylinder housing 12 and of the cylinder head 14, whereby, for cooling purposes, the coolant channels 30 of the cylinder head 14 also pass through a coolant channel 32 of an exhaust manifold that is integrated into the cylinder head 14. Furthermore, the primary cooling system comprises a motor oil cooler 34 through which coolant can flow in parallel to the coolant channels 30 of the cylinder head 14, and it also comprises a heating heat exchanger 36, a primary cooler 38 as well as a coolant pump 40. Here, the individual components of the primary cooling system are fluidically connected via coolant lines. Finally, the primary cooling system also comprises a bypass 42 that is integrated into the regulator 20 and that, while bypassing the heating heat exchanger 36 as well as the primary cooler 38, serves to connect a first inlet 44 of the regulator 20 to a first inlet 46 of the coolant pump 40.

FIGS. 2 to 6 show a possible structural configuration of the regulator 20 of the combustion machine according to FIG. 1. In this regulator 20, the lock valves 22, 24 are configured in the form of rotary valves that, depending on their particular direction of rotation, open or close inlets and outlets for the coolant that is flowing through the regulator 20 as well as for a vent line.

Figure 2:
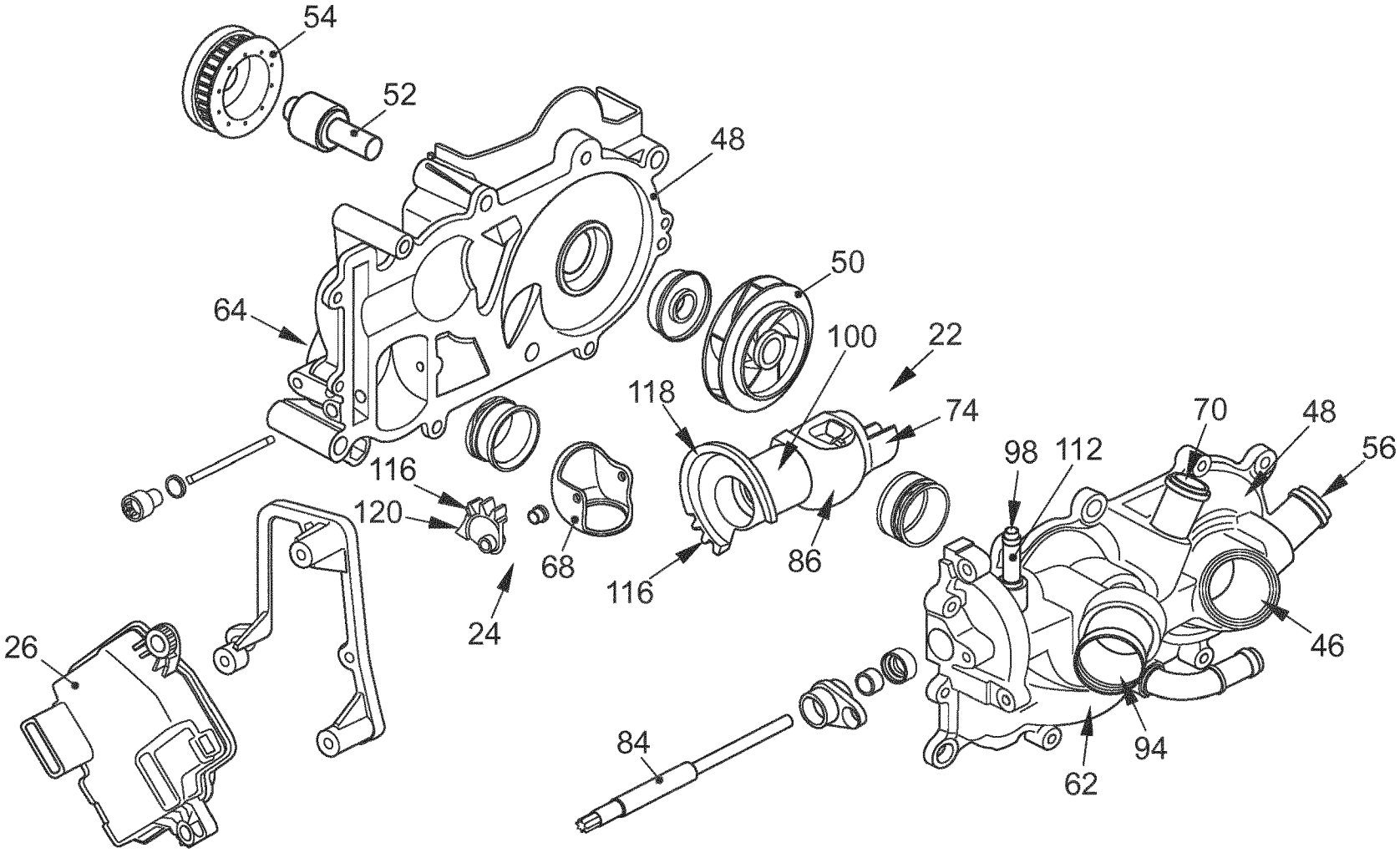
FIG. 2: a regulator for a combustion machine according to the invention, in an exploded view.
Figure 3:
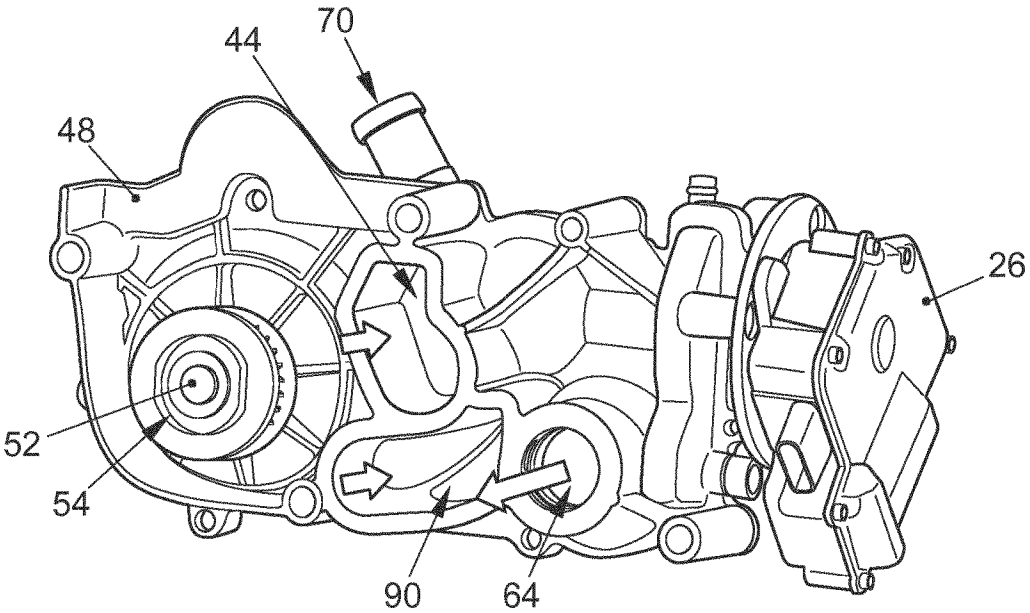
FIG. 3: the regulator in a side view.
Figure 5:
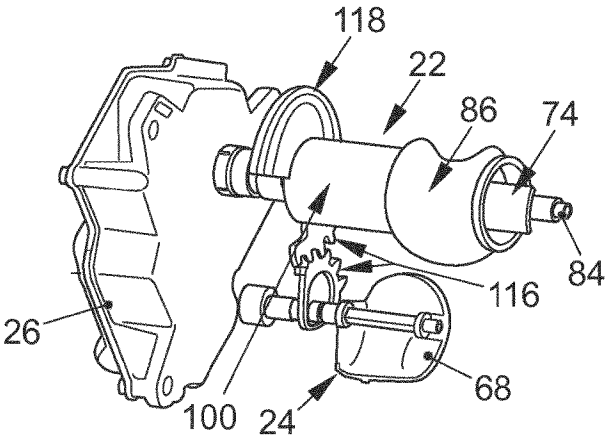
FIG. 5: an actuator and the lock valves of the regulator, which are actuated directly or indirectly by the actuator, in an isolated view.
Figure 4:
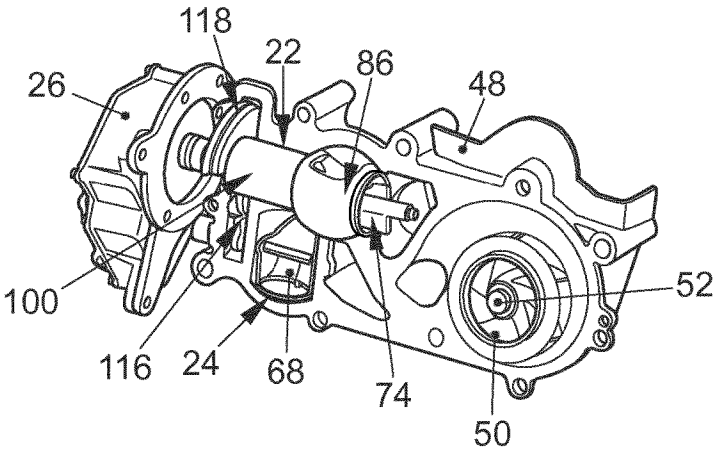
FIG. 4: the regulator with the housing only partially depicted.

Accordingly, the regulator 20 comprises a housing 48 into which an impeller 50 of a coolant pump 40 configured as an impeller pump is integrated so as to rotate. The rotation of the impeller 50 and thus the pumping of coolant in the primary cooling system are effectuated, for example, by the internal combustion engine 10, for which purpose a crankshaft (not shown here) of the internal combustion engine 10 is connected via a belt drive to a shaft 52 for the impeller 50. The only part of the belt drive that is shown in FIGS. 2 and 3 is a belt wheel 54 that is part of the coolant pump 40 and that is connected to the shaft 52.

In order for the coolant to be pumped, coolant is fed to the impeller 50 via the first inlet 46 and/or via a second inlet 56 of the coolant pump 40. The first inlet 46 is connected via a coolant line, on the one hand, to an outlet 58 of the primary cooler 38 and, on the other hand, to the bypass 42. Here, it is provided for the coolant line that forms the bypass 42 to be integrated as a channel into the housing 48 of the regulator 20. The second inlet 56 of the coolant pump 40 is connected via a coolant line to an outlet 60 of the heating heat exchanger 36.

Owing to the rotation of the impeller 50, the coolant is conveyed to a first outlet 64 of the regulator 20 through a coolant channel 62 formed inside the housing 48. When the regulator 20 is in a zero position 66, this first outlet 64 is closed by means of a closure element 68 of the second lock valve 24, which is in a closed position. This completely prevents the coolant from circulating through the cooling system. When the regulator 20 is in the zero position 66, the first lock valve 22 is in an orientation in which a second outlet 70 of the regulator 20, which is connected via a coolant line to an inlet 72 of the heating heat exchanger 36, is closed by means of a first closure element 74 of the first lock valve 22. The zero position 66 of the regulator 20 is provided for a short period of time after a cold start of the combustion machine. A cold start of the combustion machine is characterized in that the components of the combustion machine, and especially also the coolant of the primary cooling system, exhibit temperatures that essentially match the ambient temperature but that are at least below a defined limit temperature.

After a cold start of the combustion machine and after a defined first limit value has been reached for a local coolant temperature—which is measured by means of a first coolant temperature sensor 78 integrated into the coolant channel 30 in the vicinity of an outlet 76 of the cylinder head 14—the regulator 20 is switched from the zero position 66 to a first main position 80 by means of the actuator 26. For this purpose, the actuator 26 is actuated by a motor control unit 82 of the combustion machine to which the measurement signal of the first coolant temperature sensor 78 is transmitted. In this context, it can be provided that the regulator 20 is switched from the zero position 66 to the first main position 80, either stepwise or continuously, as a function of the local coolant temperature, which is measured by means of the first coolant temperature sensor 78, said switching procedure being effectuated by a rotation—associated with a rise in temperature—of the first lock valve 22 and of the second lock valve 24 that is still coupled to the first lock valve 22 so as to rotate (see FIG. 7). In this process, the lock valves 22, 24 can also be rotated back in the interim. The first lock valve 22 is rotated by means of the actuator 26, which is connected to the first lock valve 22 via a shaft 84.

When the regulator 20 is in the first main position 80, the second lock valve 24 is in an open position in which the first outlet 64 of the regulator 20 is no longer closed off by the closure element 68, but rather, it is essentially completely open. At the same time, the first lock valve 22 is in an orientation in which its first closure element 74 no longer closes the second outlet 70 but rather opens it essentially completely. At the same time, a second closure element 86 of the first lock valve 22 closes a second inlet 90 of the regulator 20 that is connected to an outlet 88 of the cylinder housing 12, and it also closes a third outlet 94 of the regulator 20 that is connected to an inlet 92 of the primary cooler 38 via a coolant line as well as the bypass 42 that is integrated into the regulator 20. Therefore, when the regulator 20 is in the first main position 80, the conveying of the coolant effectuated by the coolant pump 40 only takes place in a small cooling circuit comprising the coolant pump 40, the regulator 20, the cylinder head 14 and the heating heat exchanger 36.

After a defined second limit value has been reached for the local coolant temperature in the cylinder head 14, which is measured by means of the first coolant temperature sensor 78, the regulator 20 is switched from the first main position 80 to a second main position 96. In this process, the first lock valve 22 is rotated into an orientation in which a fourth outlet 98 of the regulator 20 is increasingly opened by a third closure element 100 of the first lock valve 22, as a result of which a first vent line 102 (with the integrated non-return valve 104) that connects the fourth outlet 98 of the regulator 20 to an expansion tank 106 (in a section of the expansion tank 106 located at the top) is increasingly opened accordingly. Starting after the second main position 96 of the regulator 20, the regulator 20 can be vented via the first vent line 102 that, with an at least slight overflow of coolant, can also be connected between the regulator 20 and the expansion tank 106 via a first overflow line 108 that branches off from a lower section of the expansion tank 106. Owing to the relatively late activation of the expansion tank 106 (after a cold start of the combustion machine), heat losses in the expansion tank 106, which would cause a delay in reaching an operating temperature range for the cylinder head 14 as well as a delay in the heating effect of the heating heat exchanger 36, can be kept to a minimum.

Figure 6:
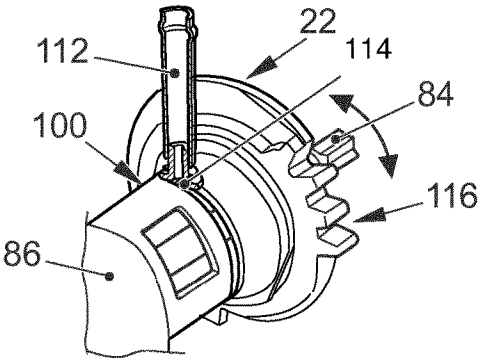
FIG. 6: a section of the first lock valve and of a connecting piece that interacts with it.

FIG. 6 shows a tubular connecting piece 112 that is integrated into the housing 48 (not shown in FIG. 6) of the regulator 20 and that is provided for purposes of connection to the first vent line 102. One end of the connecting piece 112 is movably (by rotating the first lock valve 22) mounted on a section of the first lock valve 22 that forms the third closure element 100, whereby, in the second main position 96, this end of the connecting piece 112 is arranged to be congruent with a slit-shaped through opening of the first lock valve 22, as a result of which the connecting piece 112 is then fluidically connected to a volume of the regulator that conveys coolant. In this manner, the first vent line 102 is opened. A sealing element 114 in the form of a pipe plug (that is to say, a tubular plug) made of an elastic material ensures a sufficient sealing of the connecting piece 112 vis-à-vis the third closure element 100 when the first vent line 102 is not supposed to be opened. In this context, the material of the sealing element 114 is preferably selected in such a way as to ensure low-friction sliding on the appertaining section of the first lock valve 22.

After a defined third limit value has been reached for the local coolant temperature in the cylinder head 14, which is measured by means of the first coolant temperature sensor 78, the regulator 20 is switched from the second main position 96 to a first intermediate position 110. In this process, the first lock valve 22 is rotated into an orientation in which the bypass 42 is increasingly opened by the second closure element 86, as a result of which the bypass 42 is integrated into the small cooling circuit in parallel to the heating heat exchanger 36. Here, the second inlet 90 and the third outlet 94 of the regulator 20 continue to be kept closed by the first lock valve 22. During this movement of the first lock valve 22, the second lock valve 24 remains in its open position since it is no longer coupled to the first lock valve 22 so as to rotate. Due to the integration of the bypass 42 into the (small) cooling circuit in the first intermediate position 110 of the regulator 20, the entire volumetric flow of the coolant that is being conveyed in the primary cooling system can be increased in order to achieve a correspondingly high cooling capacity for the cylinder head 14 and for the motor oil cooler 34.

The rotational coupling of the first lock valve 22 to the second lock valve 24, which is only done during certain phases, is effectuated by segment teeth 116 that are only intermeshed when the first lock valve 22 is rotated (back and forth) between the zero position 66 and the first main position 80. The second lock valve 24 is secured in its open position with a positive fit by the first lock valve 22 in that a ring segment 118 that adjoins the segment teeth 116 of the first lock valve 22 engages with a concave depression 120 that adjoins the segment teeth 116 of the second lock valve 24, and said ring segment 118 is moved relatively so as to slide in this depression 120 as the first lock valve 22 rotates, as a result of which the ring segment 118 is held so as to be non-rotatably affixed altogether.

After a defined fourth limit value has been reached for the local coolant temperature in the cylinder head 14, which is measured by means of the first coolant temperature sensor 78, and/or after a defined first limit value has been reached for a local coolant temperature in the cylinder housing 12, which is measured by means of a second coolant temperature sensor 122 situated in the vicinity of the outlet 88 of the cylinder housing 12, the regulator 20 is switched from the first intermediate position 110 to a second intermediate position 124. In this process, the first lock valve 22 is rotated into an orientation in which the second closure element 86 also (increasingly) opens the second inlet 90 of the regulator 20 (see FIG. 7). Consequently, only the third outlet 94 of the regulator 20 is still kept closed, thus preventing coolant from flowing through the primary cooler 38. Therefore, in the second intermediate position 124, it is provided that the coolant also flows through the cylinder housing 12.

After a defined fifth limit value has been reached for the local coolant temperature in the cylinder head 14, which is measured by means of the first coolant temperature sensor 78, and/or after a defined second limit value has been reached for the local coolant temperature in the cylinder housing 12, which is measured by means of the second coolant temperature sensor 122, and/or as a function of an engine characteristic map of the combustion machine stored in the motor control unit 82, the regulator 20 is switched from the second intermediate position 124 to a third main position 126. In this process, the third outlet 94 of the regulator 20 is (increasingly) opened and consequently, the primary cooler 38 is incorporated into what is then a large cooling circuit, while at the same time, the bypass 42 that is integrated into the regulator 20 is increasingly closed once again by the second closure element 86 of the first lock valve 22 (see FIG. 7). This ensures that, except for relatively small portions of the coolant that are being conveyed through the heating heat exchanger 36 and through the expansion tank 106, the coolant is fed completely via the primary cooler 38, where it is cooled by means of heat transfer to the ambient air.

A second vent line 128, which branches off from the primary cooler 38 and into which a non-return valve 130 is likewise integrated, also opens up into the upper section of the expansion tank. This advantageously allows a venting of the primary cooler 38, especially in the third main position 126 of the regulator 20.

The third main position 126 of the regulator 20 is also intended for those cases in which the combustion machine is not in operation. This is meant, on the one hand, to implement a failsafe function by means of which—in case of a defect of the cooling system that might been caused, for example, by weasel bites when a motor vehicle powered by a combustion machine was not in operation—it is also possible to continue to ensure the functionality of the primary cooling system, which, although functionally limited, nevertheless continues to provide an adequate (since it is the maximum possible) cooling capacity. Moreover, when the combustion machine is not in operation, the third main position 126 of the regulator 20 allows the primary cooling system to be filled and emptied within the scope of assembly or maintenance work, since the coolant that has been filled via the expansion tank 106 and fed into the components of the primary cooling system via the first overflow line 108 can be distributed unhindered in the primary cooling system and, in this process, air contained in the primary cooling system can escape via the first vent line 102, via the second vent line 128 and subsequently via the expansion tank 106.

The secondary cooling system of the combustion machine according to FIG. 1 comprises a cooling circuit into which the two components that have to be provided with cooling, namely, the exhaust gas turbocharger 16 and the intercooler 18, are integrated in parallel. Coolant is conveyed in this cooling circuit by means of an auxiliary coolant pump 132 that can especially be powered by an electric motor. A separate (low-temperature) cooler 134 serves to re-cool the coolant of the secondary cooling system.

The expansion tank 106 of the combustion machine is also integrated into the secondary cooling system, for which purpose a third vent line 136 is provided that is arranged in a section that—downstream from the exhaust gas turbocharger 16 and downstream from the intercooler 18 as well as upstream from the (low-temperature) cooler 134, as seen in the flow direction of the coolant—branches off from the cooling circuit of the secondary cooling system and that—incorporating a throttle element 138 as well as a non-return valve 140—is, in turn, connected to the upper section of the expansion tank 106. Moreover, a second overflow line 142 is provided by means of which the lower section of the expansion tank 106 that holds coolant is connected to a section of the cooling circuit of the secondary cooling system arranged between the (low-temperature) cooler 134 and the auxiliary coolant pump 132.

Figure 7:
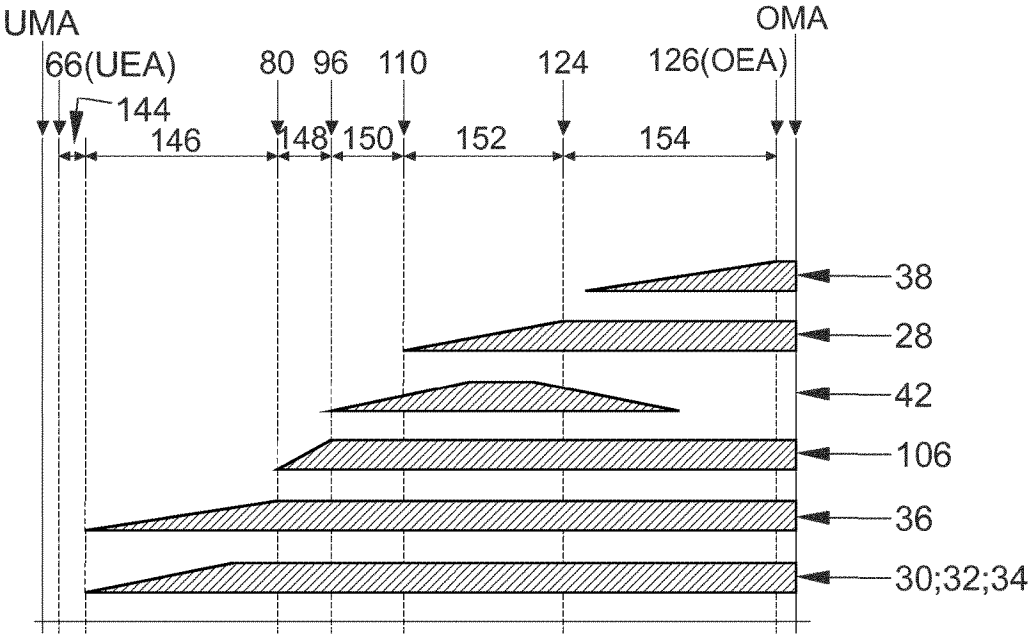
FIG. 7: the flow of coolant through the individual components of a combustion machine according to the invention as shown in FIG. 1, as a function of the various positions of the regulator.

Below, the functionalities of the primary cooling system that can be achieved by the various positions of the regulator 20 will be explained, once again in summary, making reference to FIG. 7.

When the combustion machine is not in operation (both when the coolant is still warm as well as when the coolant has cooled off completely), the regulator 20 is in the third main position 126. In this manner, the failsafe function is implemented if it is not possible to switch the regulator 20 due to a defect after the combustion machine has been started. Moreover, this makes it possible to fill and vent the primary cooling system within the scope of assembly or maintenance work, without the combustion machine having to be in operation.

In order to attain a cold start of the combustion machine, the regulator 20 is switched to the zero position 66. In this process, the zero position 66 is retained during the first warm-up phase 144. As a result, the coolant is prevented from circulating inside the primary cooling system so as to achieve a relatively fast warm-up of the coolant that is present in the internal combustion engine 10, especially in the cylinder head 14.

Relatively soon after the cold start of the combustion machine, the regulator 20 starts to be switched from the zero position 66 to the first main position 80, as a result of which the cylinder head 14 and the motor oil in the motor oil cooler 34 are increasingly cooled and the heating functionality is achieved by means of the heating heat exchanger 36.

During a third warm-up phase 148, the regulator is increasingly switched from the first main position 80 to the second main position 96, as a result of which venting of the regulator 20 can be achieved via the first vent line 102 and via the expansion tank 106. The fact that the venting only starts at a relatively late point in time reduces heat losses during the first two warm-up phases 144, 146.

During a fourth warm-up phase 150, the regulator 20 is increasingly switched from the second main position 96 to the first intermediate position 110. By means of the bypass 42, which is then increasingly integrated into the small cooling circuit, an increase in the volumetric flow rate of the coolant in the small cooling circuit can be achieved and consequently, the formation of so-called hot spots, especially in the cylinder head 14 of the internal combustion engine 10, can be avoided.

During a fifth warm-up phase 152, the regulator 20 is increasingly switched from the first intermediate position 110 to the second intermediate position 124, as a result of which the cylinder housing 12 is also increasingly cooled. The volumetric flow rate of the coolant that is being conveyed via the bypass 42 can be further increased, at least at the beginning of the fifth warm-up phase 152.

Once the coolant of the primary cooling system has reached an operating temperature range (normal operating phase 154), the regulator 20 is switched between the second intermediate position 124 and the third main position 126 by means of the motor control unit 82 as a function of an engine characteristic map of the internal combustion engine. In this context, due to an ever-greater reduction of the volumetric flow rate of the coolant that is being conveyed via the bypass 42 and due to a concurrent increase of the volumetric flow rate of the coolant that is being conveyed via the primary cooler 38, it is possible for the components of the primary cooling system to be cooled on an as-needed basis by means of a defined setting of any desired intermediate positions between the second intermediate position 124 and the third main position 126.

When the combustion machine is switched off, that is to say, when it has been changed from an operational state to a non-operational state, it can be provided that the regulator 20 is switched, first beyond the third main position 126 that constitutes an upper, electrically implemented stop (OEA) during the operation of the regulator 20, then briefly to an upper (mechanical) end stop (OMA), then to the zero position 66 that constitutes a lower, electrically implemented stop (UEA) during the operation of the regulator 20, and beyond that, briefly to a lower (mechanical) end stop (UMA), and subsequently briefly once again to the upper end stop (OMA), in order to carry out an end stop diagnosis. This can be relevant for the most exact possible switching of the regulator 20 to the various positions and intermediate positions during the operation of the combustion machine. After this end stop diagnosis, the regulator 20 can then be switched to the third main position 126 (OEA) that is intended when the combustion machine is not in operation. The largely unhindered circulation of the still-warm coolant in the primary cooling system that is achieved in the third main position 126 then also makes it possible to utilize the thermal energy stored in the coolant, for example, for a re-heating function of the heating heat exchanger 36.

LIST OF REFERENCE NUMERALS

10 internal combustion engine
12 cylinder housing
14 cylinder head
16 exhaust gas turbocharger
18 intercooler
20 regulator
22 first lock valve
24 second lock valve
26 actuator
28 coolant channel of the cylinder housing
30 coolant channel of the cylinder head
32 coolant channel of the exhaust manifold
34 motor oil cooler
36 heating heat exchanger
38 primary cooler
40 coolant pump of the primary cooling system
42 bypass
44 first inlet of the regulator
46 first inlet of the coolant pump
48 housing
50 impeller
52 shaft
54 belt wheel
56 second inlet of the coolant pump
58 outlet of the primary cooler
60 outlet of the heating heat exchanger
62 coolant channel
64 first outlet of the regulator
66 zero position of the regulator
68 closure element of the second lock valve
70 second outlet of the regulator
72 inlet of the heating heat exchanger
74 first closure element of the first lock valve
76 outlet of the cylinder head
78 first coolant temperature sensor
80 first main position of the regulator
82 motor control unit
84 shaft
86 second closure element of the first lock valve
88 outlet of the cylinder housing
90 second inlet of the regulator
92 inlet of the primary cooler
94 third outlet of the regulator
96 second main position of the regulator
98 fourth outlet of the regulator
100 third closure element of the first lock valve
102 first vent line
104 non-return valve of the first vent line
106 expansion tank
108 first overflow line
110 first intermediate position of the regulator
112 connecting piece
114 sealing element
116 segment teeth
118 ring segment
120 depression
122 second coolant temperature sensor
124 second intermediate position of the regulator
126 third main position of the regulator
128 second vent line
130 non-return valve of the second vent line
132 auxiliary coolant pump
134 (low-temperature) cooler
136 third vent line
138 throttle element
140 non-return valve of the third vent line
142 second overflow line
144 first warm-up phase
146 second warm-up phase
148 third warm-up phase
150 fourth warm-up phase
152 fifth warm-up phase
154 normal operating phase

The invention claimed is:

1. A combustion machine having an internal combustion engine and a cooling system for conveying a coolant, the cooling system comprising a coolant pump, a primary cooler, a heating heat exchanger, coolant channels in the internal combustion engine, one or more coolant temperature sensors and a regulator with an actuator, wherein the regulator can be connected to a coolant expansion tank via a connecting line and, when the actuator is actuated in accordance with a temperature of the conveyed coolant measured by the one or more coolant temperature sensors, the regulator switches between:

a first main position in which coolant is allowed to flow through the coolant channels of the internal combustion engine as well as through the heating heat exchanger and in which coolant is prevented from flowing through the primary cooler, and the connecting line is closed off;

a second main position in which the connecting line is open, and in which coolant is allowed to flow through the coolant channels of the internal combustion engine as well as through the heating heat exchanger, and in which coolant is prevented from flowing through the primary cooler; and a third main position in which coolant is allowed to flow through the primary cooler, and in which coolant is allowed to flow through the connecting line, the coolant channels of the internal combustion engine as well as through the heating heat exchanger;

wherein the actuator is configured to switch the regulator to: the first main position after the coolant temperature reaches a first limit value; the second main position after the coolant temperature reaches a second limit value; and the third main position after the coolant temperature reaches a third limit value; and wherein the first limit value and the second limit value are predefined to minimize a loss of thermal energy during a warm-up phase of the internal combustion engine by delaying a time at which an exchange of the coolant to the coolant expansion tank occurs.

2. The combustion machine according to claim 1, wherein the connecting line is a vent line that connects the regulator to a section of the expansion tank that is provided to hold air during operation of the combustion machine.

3. The combustion machine according to claim 1, further comprising a bypass that bypasses the heating heat exchanger, and wherein, when the actuator is actuated, the regulator, when it is in the first main position and in the second main position, prevents coolant from flowing through the bypass, and when it is in a first intermediate position that follows the second main position, additionally allows coolant to flow through the bypass.

4. The combustion machine according to claim 3, wherein, when the regulator is in the third main position, the regulator once again prevents coolant from flowing through the bypass.

5. The combustion machine according to claim 1, wherein the internal combustion engine comprises a cylinder housing and a cylinder head, whereby, when the regulator is in the first main position, the regulator allows coolant to flow through a coolant channel of the cylinder head and it prevents coolant from flowing through a coolant channel of the cylinder housing.

6. The combustion machine according to claim 5, wherein, when the regulator is in a second intermediate position between the second main position and the third main position, the regulator additionally allows coolant to flow through the coolant channel of the cylinder housing.

7. The combustion machine according to claim 1, wherein the regulator comprises a lock valve that is moved by the actuator, whereby the lock valve has a section in which, within a movement range that can be effectuated by means of the actuator, the lock valve is congruent with an outlet of the connecting line, whereby a portion of this section is formed by a through opening that is fluidically connected to a volume of the regulator that is provided to convey coolant.

8. The combustion machine according to claim 7, wherein the outlet is formed by a tubular connecting piece whose one end is mounted, either directly or via an interconnected sealing element, in such a way that it slides on the lock valve when the lock valve is moved by the actuator.

9. The combustion machine according to claim 8, wherein the sealing element is configured as a pipe plug that is inserted into the end of the connecting piece.

10. A method for filling the cooling system of the combustion machine according to claim 1 with coolant, wherein the regulator is switched to the third main position in order to fill the cooling system.

* * * * *